US007062437B2

(12) United States Patent
Kovales et al.

(10) Patent No.: US 7,062,437 B2
(45) Date of Patent: Jun. 13, 2006

(54) AUDIO RENDERINGS FOR EXPRESSING NON-AUDIO NUANCES

(75) Inventors: Renee M. Kovales, Cary, NC (US); James M. Mathewson, II, Chapel Hill, NC (US); Edith H. Stern, Yorktown Heights, NY (US); Barry E. Willner, Briarcliff Manor, NY (US)

(73) Assignee: International Business Machines Corporation, Armonk, NY (US)

( * ) Notice: Subject to any disclaimer, the term of this patent is extended or adjusted under 35 U.S.C. 154(b) by 1109 days.

(21) Appl. No.: 09/782,564

(22) Filed: Feb. 13, 2001

(65) Prior Publication Data

US 2002/0110248 A1 Aug. 15, 2002

(51) Int. Cl.
*G10L 13/08* (2006.01)

(52) U.S. Cl. ..... 704/260; 704/270.1; 704/258; 379/201.01; 379/67.1; 379/88.15; 84/650; 705/10

(58) Field of Classification Search ..... 704/260, 704/270.1, 3, 270, 275, 235; 705/10; 84/650; 379/201.01, 67.1, 88.15, 88.17
See application file for complete search history.

(56) References Cited

U.S. PATENT DOCUMENTS 5,384,701 A * 1/1995 Stentiford et al. ..... 704/3
5,434,910 A * 7/1995 Johnson et al. ..... 379/88.15

(Continued)

OTHER PUBLICATIONS http://odin.ee.uwa.edu.au/~roberto/research/speech/local/HOWTTS.HTM, "How Text-to-Speech Works", 6 pages.

(Continued)

*Primary Examiner*—Vijay Chawan
(74) *Attorney, Agent, or Firm*—Myers Bigel Sibley & Sajovec, P.A.

(57) ABSTRACT

Methods, systems, computer program products, and methods of doing business by adapting audio renderings of non-audio messages (for example, e-mail messages that are processed by a text-to-speech translator) to reflect various nuances of the non-audio information. Audio cues are provided for this purpose, which are sounds that are "mixed" in with the audio rendering as a separate (background) audio stream. Audio cues may reflect information such as the topical structure of a text file, or changes in paragraphs. Or, audio cues may be used to signal nuances such as changes in the color or font of the source text. Audio cues may also be advantageously used to reflect information about the translation process with which the audio rendering of a text file was created, such as using varying background tones to convey the degree of certainty in the accuracy of translating text to audio using a text-to-speech translation system, or of translating audio to text using a voice recognition system, or of translating between languages, and so forth. Stylesheets, such as those encoded in the Extensible Stylesheet Language ("XSL"), may optionally be used to customize the audio cues. For example, a user-specific stylesheet customization may be performed to override system-wide default audio cues for a particular user, enabling her to hear a different background sound for messages on a particular topic than other users will hear.

55 Claims, 10 Drawing Sheets

U.S. PATENT DOCUMENTS

| | | | | |
|---|---|---|---|---|
| 5,844,158 | A * | 12/1998 | Butler et al. | 84/650 |
| 6,108,629 | A | 8/2000 | Kasday | |
| 6,112,177 | A * | 8/2000 | Cosatto et al. | 704/260 |
| 6,125,175 | A * | 9/2000 | Goldberg et al. | 379/201.01 |
| 6,442,523 | B1 * | 8/2002 | Siegel | 704/270 |
| 6,453,294 | B1 * | 9/2002 | Dutta et al. | 704/270.1 |
| 6,459,774 | B1 * | 10/2002 | Ball et al. | 379/67.1 |
| 6,487,533 | B1 * | 11/2002 | Hyde-Thomson et al. | 704/260 |
| 6,757,365 | B1 * | 6/2004 | Bogard | 379/88.17 |
| 2002/0055844 | A1 * | 5/2002 | L'Esperance et al. | 704/260 |
| 2003/0028380 | A1 * | 2/2003 | Freeland et al. | 704/260 |
| 2003/0115059 | A1 * | 6/2003 | Jayaratne | 704/235 |
| 2003/0191682 | A1 * | 10/2003 | Shepard et al. | 705/10 |

OTHER PUBLICATIONS http://www.talktronics.com.talktronics.htm, "talkronics VIC TALKER", 3 pages.

http://readplease.com/, "ReadPlease—free text-to-speech software making life easy for the busy office", 3 pages.

http://www.voicexml:org/Review/featuares/Jan2001_what_is _voicexml.html, "VoiceXML Review—Feature Articles", 5 pages.

* cited by examiner

FIG. 3

300

| Tag 310 | Sound File 320 |
|---|---|
| <p> 311 | \tts\para.xyz 321 |
| <t> 312 | \tts\topic.xyz 322 |
| <c1> 313 | \tts\color1.xyz 333 |
| <f1> 314 | \tts\font1.xyz 334 |
| wedding 315 | \tts\churchbells.wav 335 |
| meeting 316 | \tts\papers_talking.wav 336 |

FIG. 7

700

| Translation Certainty 710 | Sound File 720 |
|---|---|
| 20 percent 711 | \tts\low.abc 721 |
| 40 percent 712 | \tts\med_low.abc 722 |
| 60 percent 713 | \tts\med.abc 733 |
| 80 percent 714 | \tts\med_high.abc 734 |
| 100 percent 715 | \tts\high.abc 735 |

AUDIO RENDERINGS FOR EXPRESSING NON-AUDIO NUANCES

RELATED INVENTIONS

The present invention is related to the following commonly-assigned U.S. patents, both of which were filed concurrently herewith and are hereby incorporated herein by reference: U.S. Ser. No. 09/782,773, entitled "Selectable Audio and Mixed Background Sound for Voice Messaging System", and U.S. Ser. No. 09/782,772, entitled "Recording and Receiving Voice Mail with Freeform Bookmarks".

BACKGROUND OF THE INVENTION

1. Field of the Invention

The present invention relates to a computer system, and deals more particularly with methods, systems, computer program products, and methods of doing business by adapting audio renderings of non-audio messages (for example, textual e-mail messages that are processed by a text-to-speech translator) to reflect various nuances of the non-audio information.

2. Description of the Related Art

Face-to-face communication between people involves many parallel communication paths. We derive information from body language, from words, from intonation, from facial expressions, from the distance between our bodies, and so forth. Distance communication, such as phone calls, e-mail exchange, and voice mail, on the other hand, involves only a few of these communication paths. Users may therefore have to take extra actions (which may or may not be successful) if they wish to try to overcome the limitations so imposed.

Distance communicating is becoming more prevalent in our society. Voice mail systems became widely used in years past, and in more recent years electronic mail systems have become common, with the popularity and pervasiveness of e-mail continuing to grow. When communicating by e-mail, message creators often try to overcome the limitations of distance communications by techniques such as using different font sizes, colors, emoticons (i.e. combinations of text symbols which bear a resemblance to facial expressions), and so forth to express non-text information. This non-text information includes emphasis, emotion, irony, etc.

Emotions may be particularly difficult to convey when using distance communication. For example, if a person is angry, it can be quite difficult to communicate that emotion in the words of an e-mail message. While a voice mail message has the advantage of conveying the speaker's (i.e. the message creator's) tone of voice, it still may not adequately represent the speaker's emotion. As another example of the difficulties of distance communication, suppose a message creator has many different topics to cover. When communicating in person, the speaker can use changes in body language to indicate a change in subject. In a voice mail message, however, it may be difficult for the listener to appreciate when one topic has ended and another has begun. In an e-mail message, the message creator may perhaps change paragraphs when the topic changes, and may use bolding and italics to give further visual clues about the number and importance of topics as well as other semantic and contextual meaning. In this case, viewing an e-mail may provide important information about the topic layout by giving the viewer a "broadside" visual overview.

A typical person using distance communications may receive a number of voice mail messages in her voice mailbox throughout the course of a day, and perhaps facsimile transmissions as well, in addition to receiving e-mail messages in an e-mail inbox. To enable people to deal with multiple sources of distance communication more effectively and efficiently, unified messaging systems have been developed. A unified messaging system provides a single interface into multiple message types, and consolidates e-mail, voice mail, and fax messages into a single mailbox so that the recipient has a common place to access her incoming messages (using either a telephone to listen to the messages, or a software application on a computer to either see a textual message display or to listen to an audio version of messages). However, unified messaging systems and network convergence may exacerbate the problems of distance communications by adding the difficulties of media transformation to the communications.

One problem with existing systems is that when e-mail is transformed via an audio read out, as is done when a unified messaging system is accessed from a telephone, much of the contextual information that the message creator attempted to convey using changes in fonts and color, emoticons, and so forth, can be lost. The loss of the context of messages may result in a loss of understanding of the topic or perhaps a loss of the underlying meaning of the message (or both). The format of the e-mail message (e.g. paragraphs, lists, and so forth) also contributes to the overall understanding of the message, as stated earlier, and the inability of a listener to perceive this formatting information can lead to a loss in meaning and understanding.

In addition to the loss of context, another problem of existing systems is that message transformations such as text-to-speech translations performed on e-mail messages are sometimes inaccurate. For example, in the sentence "They read the words aloud.", is the sentence intended to reflect the present tense, such that the pronunciation of "read" is "reed"? Or is it meant to be past tense, such that the correct pronunciation is "red"? When the recipient listens to the translated message, she may not be aware of which parts of the translation are accurate and which are not. The recipient must therefore either trust that the translated information is 100% accurate, or assume that part or none of it is accurate. In either case, a loss in communications may occur.

Loss of context and inaccurate translations may both result in wasted time and effort, and therefore decreased efficiency, for message recipients. For example, the recipient may have to spend additional time attempting to discern whether a translated message is accurate, and what the correct message was meant to be if the translation is inaccurate; similarly, he may need to spend time investigating the true underlying message if important contextual information is lost during a text-to-speech translation. Furthermore, when a message has been distorted because of lost context and/or inaccurate translation, it may be difficult to tell that a problem has occurred. If the message recipient relies on the message content without realizing that a distortion has occurred, adverse consequences may result.

Accordingly, what is needed is a technique that alleviates these problems in distance communications, providing a more accurate and more productive way for people to communicate using audio renderings of non-audio messages (such as the audio messages that result when textual messages are processed by text-to-speech translation systems).

SUMMARY OF THE INVENTION

An object of the present invention is to provide a technique that alleviates disadvantages in distance communications.

Another object of the present invention is to provide this technique by enabling a more accurate and more productive way for people to communicate using audio renderings of non-audio messages.

A further object of the present invention is to provide these advantages by augmenting a rendered audio message with audio cues that convey the degree of certainty of a text-to-speech translation that was used to create an audio message.

Still another object of the present invention is to provide these advantages by adding audio cues to audio messages resulting from a text-to-speech translation, wherein the audio cues reflect (or enhance) contextual information from the text message.

Yet another object of the present invention is to provide new methods of doing business, whereby enhanced text-to-speech translation systems can be provided to end-users, and/or features of existing systems can be improved.

Other objects and advantages of the present invention will be set forth in part in the description and in the drawings which follow and, in part, will be obvious from the description or may be learned by practice of the invention.

To achieve the foregoing objects, and in accordance with the purpose of the invention as broadly described herein, the present invention provides methods, systems, computer program products, and methods of doing business by adapting audio renderings to reflect non-audio nuances.

In one aspect, this technique comprises: detecting a nuance of a non-audio data source; locating an audio cue corresponding to the detected nuance; and associating the located audio cue with the detected nuance for playback to a listener. Or, a plurality of nuances may be detected and processed similarly. This aspect may further comprise creating an audio rendering of a non-audio segment of the non-audio data source, wherein the non-audio segment is associated with a detected nuance, and mixing the associated audio cue with the audio rendering of the segment.

The non-audio data source may be a text file (including an e-mail message), and creating the audio rendering may further comprise processing the text file with a text-to-speech translator. The detected nuances may be a number of things, including but not limited to: presence of a formatting tag (such as a new paragraph tag); a change in color or font of text in a text file; presence of a keyword for the text file (where this keyword may be supplied by a creator of the text file, or may be programmatically detected by evaluating text in the text file); presence of an emoticon in the text file; a change of topic in the non-audio data source; identification of a creator of the non-audio data source (which may be used to locate stored preferences of the creator; note that the message creator is not limited to a human being, but may refer for example to a programmatic message generator); an e-mail convention found in the e-mail message; etc.

Selected ones of the detected nuances may be embedded within the non-audio data source, while others may comprise metadata associated with the non-audio data source.

The detected nuances may in some cases be a degree of certainty in translation of the non-audio data source from another format. In this case, if at least two different degrees of certainty are detected, the located audio cues may comprise changes in a pitch of a voice used in the audio rendering for each of the different degrees of certainty, or changing a pitch of the associated audio cue used by the mixing for each of the different degrees of certainty. If the other format is an input audio data source and the non-audio data source is a text file, and the translation is an audio-to-text translation from the input audio data source to the text file, then the degree of certainty may reflect accuracy of the audio-to-text translation, identification of a speaker who created the input audio data source, etc. Or, if the other format is a source text file and the non-audio data source is an output text file, and the translation is a text-to-text translation from the source text file to the output text file, then the degree of certainty may reflect accuracy of the text-to-text translation (and the source text file may contain text in a first language while the output text file contains text in a second language).

The non-audio data source may be text provided by a user (e. g. by typing the text as command line input).

In another aspect, the present invention provides a technique for enhancing audio renderings of data sources by transforming a first data source in a first format to a second data source in an audio format; associating one or more degrees of certainty with the second data source to reflect an accuracy of the transformation; locating an audio cue that is correlated to each of the associated degrees of certainty; and associating the located audio cues with the second data source to convey the accuracy of the transformation to a listener who hears the audio format. This technique may further comprise audibly rendering the second data source to the listener along with the associated audio cues.

In yet another aspect, the present invention provides a technique for enhancing audio renderings of non-audio data sources by providing a stylesheet comprising rules and actions, wherein selected ones of the rules and actions pertain to audio cues to be used in an audio rendering; comparing the rules of the stylesheet to content of a non-audio data source; and upon detecting a match during the comparison, applying the action associated with the matching rule, wherein for each action pertaining to audio cues, an audio cue is thereby associated with the non-audio data source for playing the audio rendering to a listener. This technique may further comprise playing the audio rendering. Selected rules and actions of the stylesheet may be customized for the listener (or for a creator of the non-audio data source), in which case at least one of the audio cues associated with the non-audio data source by the application of actions may override another audio cue in order to customize the audio rendering for the listener (or to make the audio rendering speaker-specific). One or more of the audio cues associated with the non-audio data source by the application of actions may change a pitch of a speaker's voice used in playing the audio rendering. Or, the stylesheet may specify preferences for language translation of the non-audio data source that may be performed prior to playing the audio rendering. The stylesheet may be an Extensible Stylesheet Language ("XSL") stylesheet, or any other type of stylesheet.

The present invention also provides a method of merchandising pre-recorded audio cues by receiving requests for selected ones of the pre-recorded audio cues for use as background sounds to be mixed with audibly rendered messages in order to provide enhanced contextual information to a listener of the audibly rendered messages, and providing the selected ones, in response to receiving the requests. The provided pre-recorded audio cues may be used as an audio cue library.

The present invention will now be described with reference to the following drawings, in which like reference numbers denote the same element throughout.

BRIEF DESCRIPTION OF THE DRAWINGS

FIGS. 3 and 7 are tables showing examples of how the contextual information of a message may be correlated with audio cues (i.e. sounds) to be used when rendering the message, according to preferred embodiments of the present invention;

DESCRIPTION OF THE PREFERRED EMBODIMENTS

Figure 1:
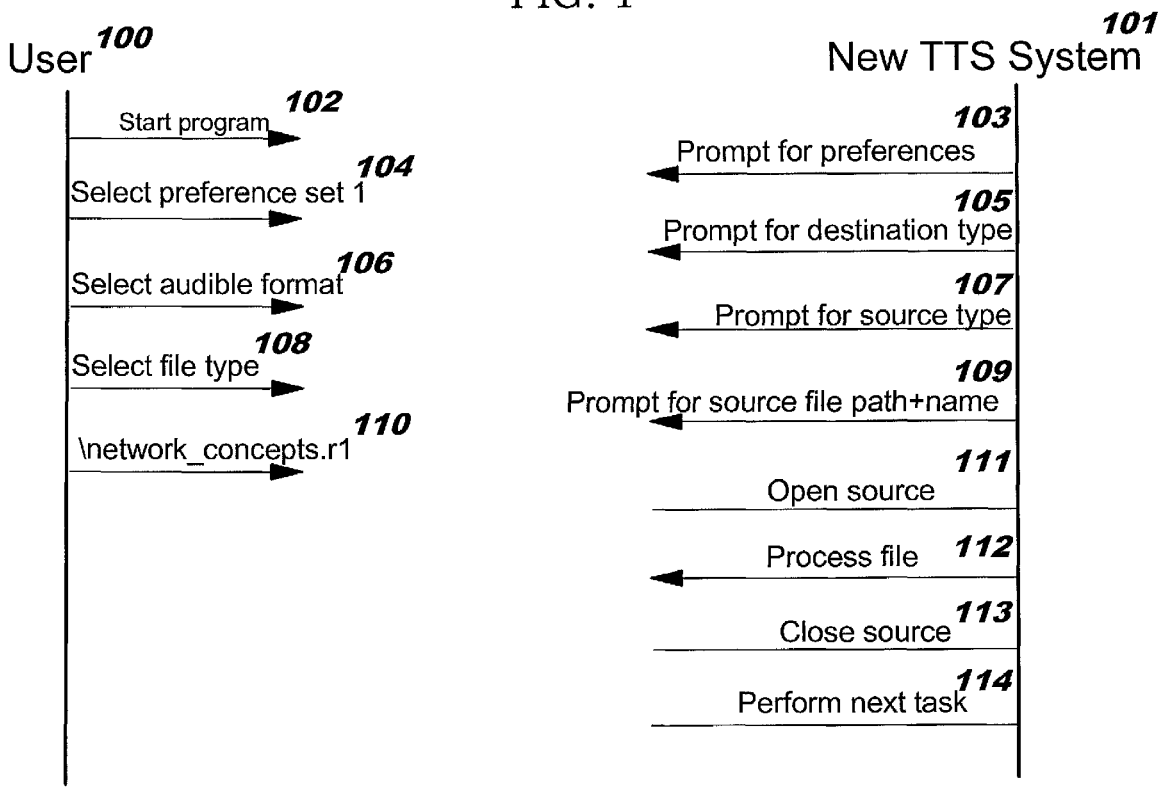
FIG. 1 is a flow diagram illustrating an example of how a message recipient may invoke a system which provides features of the present invention.

The present invention improves distance communications which use messages rendered in audio form, and in particular, audible messages that result from translating a non-audio message (such as an e-mail message or other textual message or file) into an audio form for playback to a listener. Additional context beyond the audibly rendered word is provided during audio messages when using the teachings of the present invention in order to express various nuances of the non-audio message. The disclosed techniques enable (inter alia) the listener to regain contextual information that has been lost in a text-to-speech translation process, and/or to perceive how accurate this translation is estimated to be, using audio cues that are rendered simultaneously with the audible message. Furthermore, techniques are disclosed which associate additional contextual information with a rendered message through use of added audible information, such as a background sound which is appropriate to the topic, thereby enhancing the listener's understanding of the message.

As an example of how the present invention may be used to enhance the context of an audio message, an audio cue may be mixed in with an audio rendering to minimize the effect of a media transformation from a non-audio source such as text. In one embodiment, each paragraph of an underlying text message is taken to be a different message segment. A different sound is associated with each paragraph (i.e. each message segment) and mixed into the message as the paragraphs are being played to the listener, such that the listener receives an audible signal of the paragraph changes. If, as in the previously-discussed example, an e-mail creator organizes his email message into different paragraphs that discuss different topics, this audible signal also implicitly informs the listener when the topic of the message changes. In either case, the audible signals enable the meaning of the e-mail message to be conveyed more accurately when it is rendered to the listener.

In another embodiment, an appropriate audio cue is mixed with an audio rendering resulting from a text-to-speech transformation, thereby providing additional (parallel) information as to context. An appropriate audio cue may be determined in several ways. For example, if the message originator has supplied keywords for the message or for segments of the message, then these keywords can be used as a source of cueing. Today's e-mail systems, however, do not provide a feature for associating keywords with messages or message segments. Thus, the present invention also provides for programmatically selecting keywords from a message and then using these selected keywords to use as a source of cueing. For example, if the first sentence of a paragraph reads "The wedding date has been set.", then an appropriate audio cue may be the sound of church bells. If, on the other hand, the sentence reads "The meeting was very productive.", then an appropriate audio cue may be the sound of papers rustling, and low background conversation.

Note that the present invention is not directed toward inserting an audio cue or sound in-line as message content while a message is being rendered (e.g. a giggle sound in place of a smiley-face emoticon): this is known in the art. Instead, the present invention is "mixing" (or perhaps marking, for subsequent mixing) an audio file or audio data source as additional sound for a message that is being rendered—or for some part of a message that is being rendered. (Note that the mixing of the audio data source is not required to occur as the message is being played to a user. Instead, the mixing may occur at playout or earlier. Furthermore, it is to be noted that references herein to "audio file" are not meant to limit the present invention to concepts of a static, previously-stored file. Any audio data source may be used, including streaming audio. In some embodiments, it may be desirable to use a conferencing technique for mixing the background sound with the audio data source, such that the mixing occurs at life-like speeds.)

A text-to-speech transformation system known as "VIC-TALKER", produced by a company called "talktronics", has a proofreading mode where punctuation symbols can be explicitly audibly rendered to the listener. However, to the best of the inventors' knowledge and belief, VIC-TALKER provides these indications of punctuation only as in-line content, and does not provide indications of paragraph changes (or indications of other contextual information) by mixing in additional sounds or audio streams. (See location http://www.talktronics.comltalktronics.htm on the Web for more information on the VIC-TALKER software.)

According to the present invention, audio cues can also be used to provide additional contextual information related to message translation. For example, when language translation by machine is involved, audio cues can be used to indicate the degree of certainty in the translation. A background hum, mixed in with the audio stream resulting from the translation, might indicate certainty of translation, with higher pitches indicating more certainty and lower pitches indicates less. As another approach, the pitch of the voice used for the audio rendering might change to indicate that the certainty of the translation varied. This type of audio cue can be beneficially employed in audio-to-audio transforms as well, such as a spoken message that is processed with voice recognition software to generate a text file, where this text file is then processed by a text-to-speech translation system. Furthermore, audio cues are beneficial in text-to-speech transformations that also involve changes from one language to another. For example, if an e-mail message originally created in English is translated programmatically into a textual e-mail message in French, and then a text-to-speech translation to generate audible French from the e-mail message occurs, audio cues may be provided to indicate to the listener how certain the results of these two transformations are believed to be. (For purposes of the present invention, it is assumed that transformation algorithms of this type are cognizant of the certainty of the transformations they perform, and are adapted to providing this certainty information, e.g. through an application programming interface.)

Audio cues of the type provided by the present invention may also be used advantageously in other scenarios which involve non-audio information. For example, it may be desirable to programmatically identify the speaker leaving a voice mail message, perhaps by using voice recognition software to compare the message to a database of known speakers. A background tone mixed in with the spoken voice mail message can then be used to indicate the degree of certainty in the identification. (Techniques for programmatically identifying a speaker by analysis of voice characteristics such as physical and habitual speech nuances are known in the art. See, for example, U.S. Pat. No. 6,073,101, entitled "Text Independent Speaker Recognition for Transparent Command Ambiguity Resolution and Continuous Access Control".) Audio cues can also be used to highlight selected passages of audibly rendered messages as to the degree of certainty, as in the example discussed above, where the audible message results from text that was created by voice recognition software from a source (spoken) message.

Documentation for the VIC-TALKER system states that a variable pitch can be used to emphasize certain elements of the audibly rendered message, such as statements, questions, and exclamations. However, there is no discussion therein of using pitch for indicating certainty of translation nor is there a discussion of using audio cues to suggest certainty of a programmnatic recognition of the identity of an original speaker.

As another example of advantageous use of audio cues, an audio cue could be used in a text-to-speech system to indicate the color of the text being translated. A change in the color may indicate the message creator's intent to show emotion (e.g. certain words were typed in red font to indicate anger), or the degree of importance (perhaps the very important or "hot" words are typed in red), or simply a change in topic, and so forth. In this case, the background hum or voice pitch as described above could change to reflect these types of textual nuances, or a background audio cue might change to a completely different sound while such text passages are being rendered. Other textual nuances of this type include changes in font, text size, text appearance, etc. Furthermore, the use of audio cues as disclosed herein may provide a novel technique for rendering emoticons audibly. Prior art systems may read the characters of the emoticon, or interpret those characters and insert a sound for the emoticon (e.g. either by playing a giggle sound for a smiley face, or speaking "smiley face"). The present invention, on the other hand, enables interpreting the emoticon and mixing in an associated sound concurrently with the audibly rendered text of the message; for the smiley face example, a giggling sound may be played as background for the text preceding (or following) the characters of the emoticon.

Once the teachings of the present invention are known, audio cues may be used advantageously in a myriad of ways to enhance distance communications by adding and/or enhancing context information.

In an optional aspect of the present invention, stylesheets may be used to customize the audio cues. Stylesheets may be used to search through documents (in particular, non-audio documents such as text files), comparing a searched document against particular patterns encoded in the stylesheets; upon detecting a match, rules encoded in the stylesheet are then used to customize the document when it is rendered in audio format. One type of customization may be to influence the pitch of the tone(s), or other attributes, used in the audio rendering. For example, it is contemplated that implementations of the present invention may be used in environments where a number of system-wide defaults are in place, such as use of American English pronunciation for rendering audio messages. A particular message recipient in this environment may prefer to have audio messages rendered using British pronunciation and/or a British voice. Or, a message recipient may wish to suppress language translation for e-mail messages written in French, such that the audibly rendered message is also in French rather than being translated to a system default of English. Stylesheets may also be used to specify translations and renderings into multiple languages. For example, a message recipient who speaks both English and Spanish may specify that any textual messages written in English or Spanish are to be audibly rendered without language translation; textual messages written in Italian are to be translated into Spanish, and audibly rendered in Spanish (based on an assumption that Spanish translates more accurately to Italian than to English, perhaps); and textual messages in other language are to be translated to English prior to the audible rendering.

Furthermore, stylesheets may be merged by a stylesheet processing engine (using prior art techniques) as they are applied to a source document: such merged stylesheets enable a system using the teachings of the present invention to apply hierarchical preferences for the translations to be performed (e.g. a company-wide translation preference that may be overridden by a site-wide translation preference which may be overridden by group translation preferences which in turn may be overridden by personal translation preferences and so forth).

Another type of customization provided herein using stylesheets may be to override one set of audio cues with another, based on the outcome of the pattern-matching process that occurs when the stylesheet(s) is/are applied. A system default for text that would be visually rendered in red might be to use an angry voice or perhaps a rolling thunder background audio cue when rendering the message audibly; an individual may prefer to override these defaults to have a staccato voice read such passages, or to use a background with lightning strikes. As another example, a system default audio cue for a "wedding" context might be to play church bells, whereas a particular message recipient may choose to have chords of a musical selection played instead.

Stylesheets may be used to provide these and other types of listener-specific or message-driven alterations. In addition, stylesheets may be used to programmatically detect the message creator in some cases, and to provide personalizations or customizations using this person's stored preferences. (For example, an identifier of the message creator may be used to access a directory or other repository in which preference information is stored. If no information is found therein for a particular message creator, then default preferences are preferably used.)

Stylesheets such as Extensible Stylesheet Language ("XSL") stylesheets may be used. Stylesheets operate upon source documents containing markup tags, where a markup tag is a predefined sequence of characters, often surrounded by special characters. For example, the character sequence "<p>" indicates a new paragraph in many markup notations. Markup tags are common in e-mail documents and Web pages that are encoded using a markup notation such as HTML (HyperText Markup Language) or XML (Extensible Markup Language). Markup tags are normally invisible to a document recipient, such as the tags used to format the present document, and may comprise simply a hexadecimal code (representing, for example, a "line return" within a text file). Some type of markup tag is present in most text documents.

Prior art text-to-speech systems typically allow users to specify attributes of the audible rendering (such as whether the voice will be a male or female voice, the preferred language accent; and so forth) using menu options. Stylesheets, as has been described above, provide a much more powerful and more flexible technique than use of menu options.

Prior art text-to-speech systems allow creation of a personal dictionary to be used in the translation process. For example, the "ReadPlease" translation system provides a dictionary that may be used to store customized pronunciation of words. (See location http://readplease.com for more information about this product.) Prior art systems may also be trained or configured for specific types of translations. As an example, e-mail message creators have adopted conventions such as using capital letters or special characters surrounding a word or phrase to indicate an emphasis on this text to the reader. Thus, a sentence typed as "You WILL attend the meeting." will be audibly rendered by such systems with an emphasis on the word "will". (Refer to http:/Hodin.ee.uwa.edu.au/~roberto/research/speech/local/HOWTOTTS.HTN" for a discussion of prior art text-to-speech translation systems and e-mail conventions.) However, no systems are known to the inventors of the present invention that use stylesheets for customization or translation. Furthermore, no systems are known which provide mixed-in background audio cues to represent e-mail conventions.

A markup language known as "VoiceXML" combines audio input and output with markup tags, and is based on the Extensible Markup Language ("XML"). Voice recognition may be used with VoiceXML documents (i.e. textual scripts containing markup tags) to drive an application program in a similar manner to controlling the same application through a graphical browser interface on a personal computer. For example, rather than a computer user interacting with an application program by selecting icons on a graphical user interface display, a telephone caller may give commands to a voice recognition system which converts the spoken commands to text; the text is then used as input to be matched against a VoiceXML document which operates with the application program. The textual scripts or documents used with VoiceXML audio output contain special speech-oriented tags that may be used to provide audibly rendered output from an application program. For example, if the document includes an "<emp>" tag, the text associated with that tag will be emphasized in some way when it is processed through a text-to-speech translation system. A number of other speech-specific tags may be used in VoiceXML documents, such as "<break>" to generate a pause in the rendered audible output; " " to indicate a division, such as a paragraph or sentence, in the document's text; and "<pros>" to control prosodic attributes such as the speaking rate and volume. However, the techniques of the present invention differ from use of VoiceXML in a number of ways. To the best of the present inventors' knowledge and belief, the audible information provided with VoiceXML is used in creating the rendered voice, not as a background audio cue that is to be rendered in addition to the voice of a text-to-speech translation as disclosed herein. In addition, the present invention does not limit audio cues to operating on special, predefined speech-oriented markup tags: instead, the present invention operates with markup tags of any type which may be provided in an underlying text document and/or with explicitly-provided keywords of any type (and/or programmatically-deduced keywords). Furthermore, there is no teaching within the VoiceXML specification of using background audio cues to indicate the certainty of translation for non-audio information that is being audibly rendered. (The VoiceXML tags discussed above are referred to in the VoiceXML specification generally as "prompts". See "Voice extensible Markup Language: VoiceXML", dated Mar. 7, 2000, and in particular, Chapter 13 thereof. This document may be obtained at Web location http://www.voicexml.org/specsNoiceXML-100.pdf. For a brief article summarizing VoiceXML, see "What is VoiceXML" by Kenneth G. Rehor, located on the Web at http://www.voicexmlreview.org/features/Jan2001_what_is_voicexml.html.)

A number of different embodiments of the present invention may be implemented using the teachings disclosed herein. Preferred ones of these embodiments will now be described with reference to the accompanying drawings.

FIG. 1 illustrates an example of how a text-to-speech ("TTS") system providing features of the present invention may be invoked. A message recipient (user 100) starts the TTS system 101, as shown at 102 (e.g. by clicking on an icon on a computer screen; by using dual tone multi-frequency, or "DTMF", keys in a telephone client once a unified messaging system has been dialed; or by any analogous means). The TTS system may then prompt 103 the user for his preferences. Suppose for purposes of illustration that sets of preference information have previously been stored in the TTS system, and these stored sets may be identified using numeric values. The user in this example wishes to use the preference set associated with value "1", and thus indicates this preference to the TTS system at 104. Such stored preferences may comprise many different types of information, such as whether user 100 wishes to have a man's or woman's voice reading the rendered messages; whether all messages should be rendered, or only newly-arrived messages; which listener-specific dictionary should be used with the rendering (which may supply, e.g., pronunciation of unusual words that commonly appear in this listener's e-mail), and so forth. Use of previously-stored preferences may be omitted in some implementations, and when used, preference information may be obtained in ways other than prompting the user, using techniques which are known in the art and which do not form part of the present invention. (For example, an identifier may be transmitted by the telephone client, where the TTS system associates this transmitted identifier with a particular individual who owns the telephone and then uses the association to retrieve the individual's stored preferences.)

(As an alternative to providing a numeric reference to previously-stored preference information, as described for element 103 of FIG. 1, an implementation may perhaps allow the user to identify a stylesheet that is to be used for evaluating preference information. As with the reference to previously-stored preferences, the user's selection may be provided in a number of ways. For example, if the user is using a computer, he may select a particular stylesheet from a graphical user interface, or he may perhaps have a default stylesheet stored in configuration information of his computer where that information can be transmitted to the TTS system either automatically or upon request. If the user is using a telephone, then he may perhaps identify his stylesheet preference by speaking the name of the file in which it is stored, assuming that voice recognition software is in place to interpret his command. Other techniques may be used if desired.

The TTS system may then prompt the user for the type of destination file to be rendered, as shown at 105. In this example, the user responds 106 that he wishes to receive an audible rendering. The TTS system may then ask for the source file type, as shown at 107, to which the user may respond 108 that he would like to have a stored file (such as an e-mail message) rendered. Next, the TTS system asks 109 the user to identify the particular file to be rendered. In the example of FIG. 1, the user selects a file named "network_concepts.r1", as shown at 110. If the user is using a software client on a computer workstation, he may type the source file name into a prompt window, or select from among multiple source files using a list that is transmitted by the TTS system, or browse through a file structure to locate a particular file, and so forth. If the user is using a telephone client, he may select a source file using a touch-sensitive display screen on the telephone, or press a particular button or key that is associated with his desired selection, or perhaps speak the file name into the phone for processing with voice recognition software, etc. The particular technique used to convey selections to the TTS system does not form part of the present invention. (In some implementations, it may be assumed that the source type is a stored text file and/or that the destination type is an audio rendering, in which case it is not necessary to prompt a user to make a selection for these parameters. Furthermore, some implementations may be configured or otherwise adapted to use a particular source location for messages, such as a predetermined in-box of a unified messaging system. In this case, it is not necessary to ask the user for the location of the source file. The corresponding actions shown in FIG. 1 may then be omitted.)

Once the TTS system knows which file is to be rendered, it opens the file (111), and then processes that file (112). In this example, the processing at 112 comprises translating the contents of file "network_concepts.r1" into speech and playing that speech to the user. One example of the manner in which a text file may be processed for audio rendering to a user is described in more detail below, with reference to FIG. 2. (FIGS. 4 and 6, discussed below, provide alternative approaches.) When the rendering is complete, the source file is preferably closed (113). The TTS system may then perform another task (114), such as returning to flow 107 to ask the user for a next file to be rendered, or returning to earlier flows to allow the user to alter other parameters. Or, the TTS system may simply end this interaction with the user.

Figure 2:
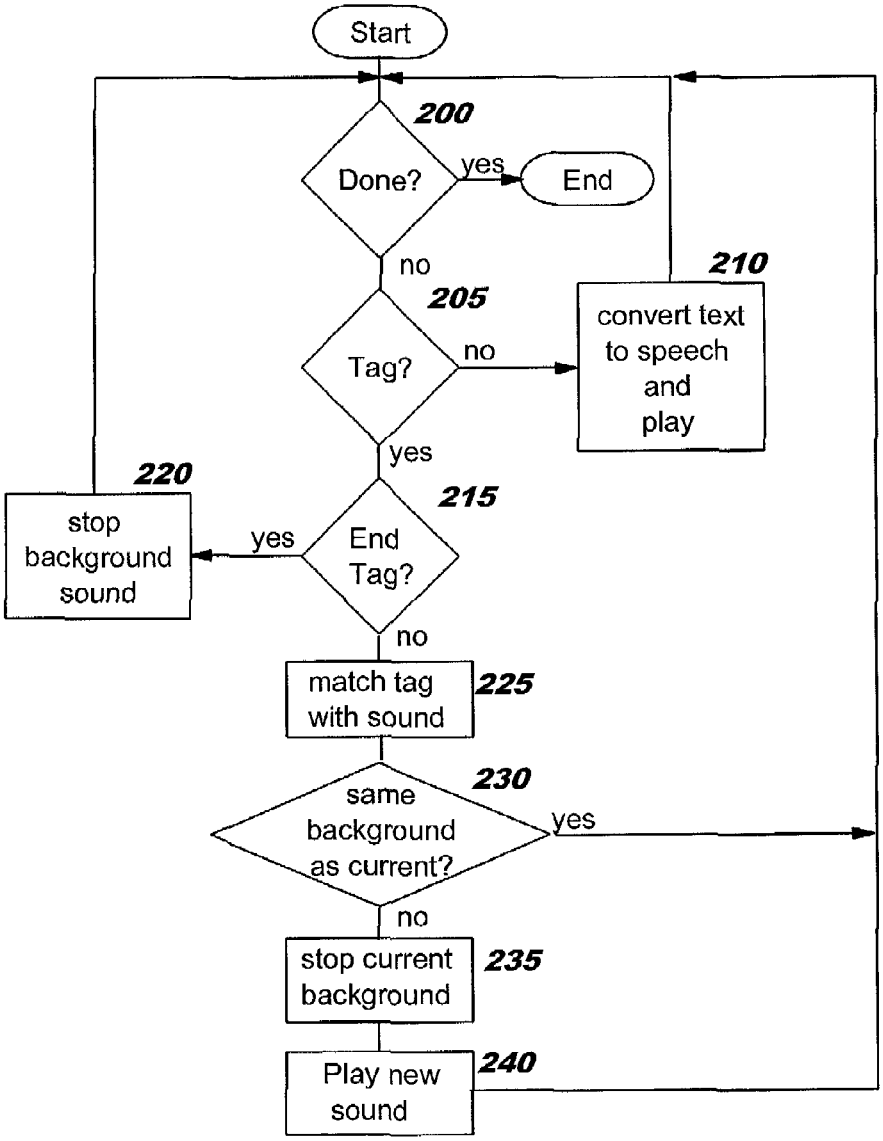
FIGS. 2, 4, and 6 provide flowcharts illustrating logic that may be used to provide enhanced message context to an audio message recipient, according to preferred embodiments of the present invention.

Referring now to FIG. 2, logic is shown that may be used to implement preferred embodiments of the present invention to provide context-enhanced audio renderings of non-audio (in preferred embodiments, textual) information. For purposes of FIG. 2, it is assumed that tags are associated with textual messages and/or segments of textual messages, and that a particular message has one or more of these tags associated with it. A tag may be a special character or code used to indicate text formatting (such as a new paragraph indicator, an ordered list indicator, a bold font indicator, and so forth) to the text processing software of the message creator's e-mail system or other text editor. These type of tags are typically provided in rich text documents (i.e. "RTF" documents), HTML and XML documents, and so forth, as previously discussed. (The related invention titled "Recording and Receiving Voice Mail with Freeform Bookmarks" describes another way in which message segments and tags may be used.) Message creators may in some cases explicitly type the special characters of one or more tags into a message, including tags that are user-defined. (For example, a user may place the character string "<wedding>" into her e-mail message in-line to convey contextual information, where the present invention then detects this tag and provides a wedding-related audio cue as the message is being rendered in audio form.) Or, messages may have one or more associated keywords that have been explicitly provided by the message creator as metadata to convey contextual information for the message. Metadata is not stored in-line when using the present invention, but rather is separately stored (e.g. in a header or header data structure for the message). Preferably, an application programming interface or graphical user interface is provided when using metadata, and solicits and/or accepts input from the user and then stores this data such that it can be associated with the appropriate segment(s) of the message. (A data structure that may be used for associating tags and/or keywords with message segments is described below, with reference to FIG. 8.)

The rendering of a message enhanced with audio cues based upon embedded tags (such as "It is <italics>really</italics> hot today!") begins at Block 200, which asks whether the processing for this message is complete. If this test has a positive response, then the traversal of FIG. 2 ends. Otherwise, processing continues to Block 205 which checks to see if the next message token or element to be rendered for this message is a tag. If it is not (i.e. it's a word), then the message element is rendered by converting the text to speech at Block 210 (preferably using prior art TTS translation techniques), after which control returns to Block 200 to process the next element of this message.

Control reaches Block 215 when the current message element is a tag. In one aspect, tags used by the present invention may have corresponding end tags. (In an alternative aspect, an ending tag may be implicitly indicated by the presence of a new opening tag. In this alternative aspect, the logic of Blocks 215 and/or 220 may be omitted. For example, in HTML the presence of a <p> tag implicitly ends the prior paragraph and starts a new one. ) When an end tag is detected in Block 215, the current background sound (i.e. the sound that is currently being mixed into the audio rendering), if any, is stopped (Block 220). Control then returns to Block 200 to process the next message element (which may or may not use a new background sound).

When the tag located by Block 205 is not an end tag, Block 215 has a negative result and control therefore reaches Block 225. Block 225 then operates to find a sound that is associated with this particular tag. FIG. 3 illustrates one format of a data structure that may be used for this purpose, as will now be described.

As shown in FIG. 3, a table 300 may be constructed which links tag values 310 to stored sound files 320. In this example, the paragraph tag "<p>" 311 that may be used in a stored textual message or document to indicate a new paragraph is associated with a sound file stored at a hypothetical location "\tts\para.xyz" 321, and a tag "<t>" 312 that may be defined for delineating topics within a text file is associated with a sound file "\tts\topic.xyz" 322. (As an alternative to this explicit linking of a tag with a sound file, the tag may instead identify a category of sounds, where a particular sound may then be selected from this category for use with that tag. The manner in which the tag is selected in this case is beyond the scope of the present invention, and uses techniques which are well known in the art.)

Upon locating a sound file associated with a tag, the sound file is then played to the listener (as will be discussed in more detail with reference to FIG. 2) while the audio rendering of the paragraph or topic takes place. (Preferably, if the audio cue is of longer duration than the corresponding message elements, the audio cue is truncated once playback of the voice message elements completes. If the audio cue is of shorter duration than the corresponding message elements, the audio cue may be allowed to end while the audio message continues to play; or, alternatively, the audio cue may be "wrapped" such that it repeats as many times as necessary until the audio message element playback is complete.)

Table 300 also contains entries associating a "<c1>" tag 313 which, for purposes of illustration, is used as a tag in a stored text file to indicate that the color of the text has changed to some color identified as color "1", and a tag "<f1>" 314 which is used to indicate that the font has changed to some font "1". The corresponding sound files for these tags are stored in "\tts\color1.xyz" 333 and "\tts\font1.xyz" 334. In addition, entries 335 and 336 illustrate one way in which speaker-supplied keywords may be handled when using the present invention. In this approach, specific keywords "wedding" and "meeting" are associated with sound files "\tts\churchbells.wav" 335 and "\tts\papers_talking.wav" 336, respectively. Note that these entries 315 and 316 represent keywords, which are to be distinguished from tags: tags typically use a special symbol such as the surrounding angle brackets shown in entries 311–314 of table 300, and appear in-line within the text file. For example, a color tag may precede words or keystrokes that are shown in a different color within a visual rendering of the text file (where an ending color tag, such as "</c1>", may then follow those words or keystrokes in some notations such as XML). User-provided keywords may appear in-line as a type of user-defined tag to be processed by the present invention, as discussed above. Keywords of the type shown in entries 315 and 316, on the other hand, are preferably associated with text in another way (e.g. the keywords may be stored in metadata for the text file, such as in a file header or other associated structure). An implementation of the present invention may choose to support only tags, only keywords, or both tags and keywords. In the latter case, the sound file associations for the tags and keywords may be stored in separate data structures, or may be intermingled as shown in FIG. 3. Furthermore, an implementation may choose to support only tags created by text processing software (such as HTML tags, XML tags, tags created by a particular word processor, etc.), or tags created explicitly by users, or both.

When user-defined keywords are supported and are embedded within a text file to provide audio cues, it is implementation dependent as to whether that keyword will be announced, in addition to being used to locate an audio file. For example, referring again to the "<wedding>" keyword, an implementation may support the text "<wedding> I hope to see you next month at my wedding." by playing an audio cue associated with the keyword as the entire sentence is audibly rendered. Another implementation may choose to announce the word "wedding" upon encountering the keyword, and then use the located audio cue as the sentence is rendered (and the word "wedding" is rendered again).

Note that the entries in table 300 of FIG. 3 are shown using file locations for the audio files. An identifier which correlates to a file location, or an address such as a Uniform Resource Locator (URL), may be used equivalently. The present invention enables new methods of doing business, for example by merchandising sound files to be used as audio cues. These sound files may be obtained, for example, from a sound merchandiser over a connection to a remote location such as the Internet. A particular file may be obtained dynamically at the time when it is needed for playback to a listener, or a collection of files may be obtained a priori and used as an audio cue library in an environment where the present invention is implemented. The sound might be provided in other ways as well, such as by streaming from an on-line system, thereby eliminating the need for downloading the sound file.

Figure 4:
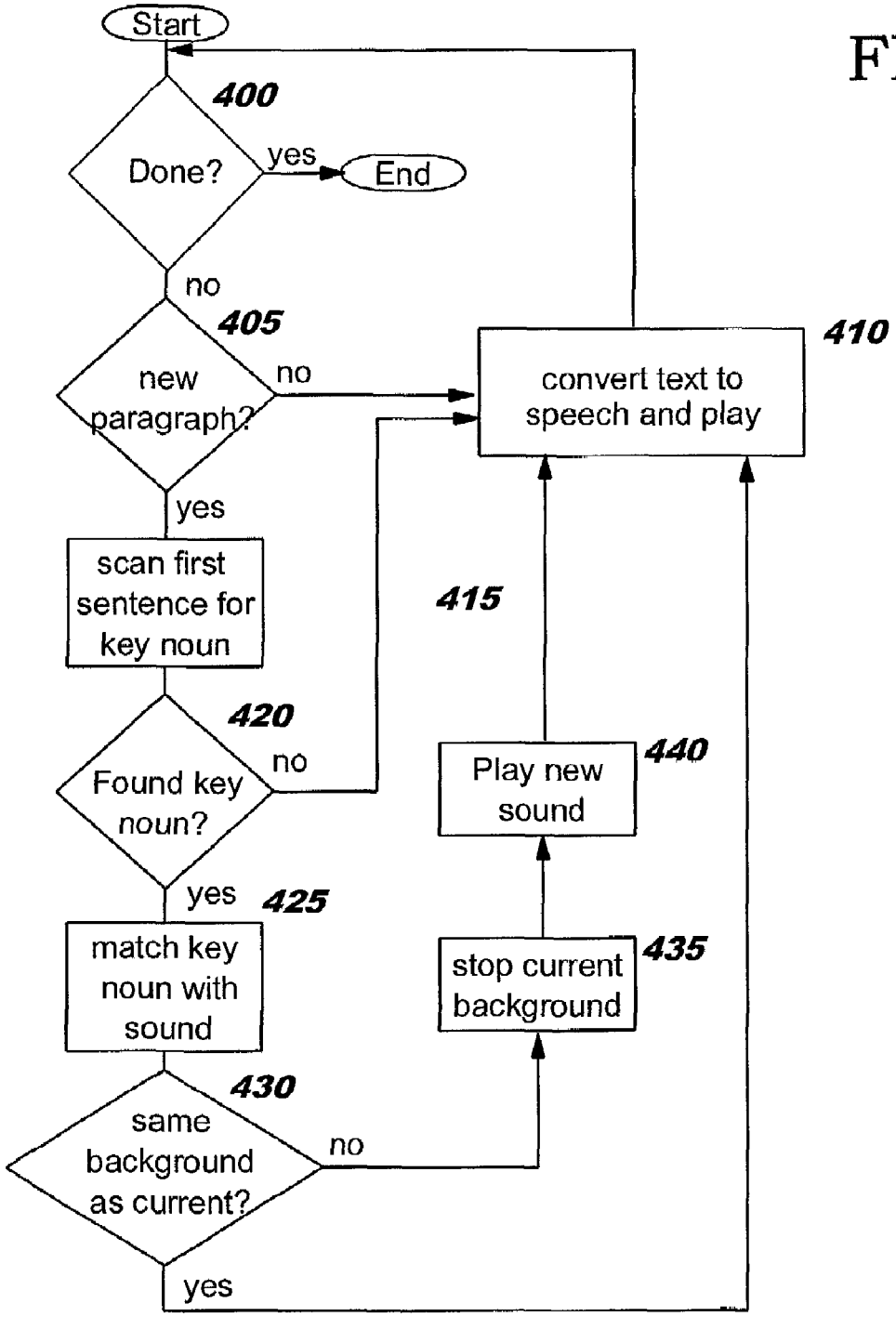

User-supplied keywords that are embedded within a text file may be processed in a similar manner to that illustrated in FIG. 2 for processing tags. FIG. 4, discussed below, provides logic that may be used to process keywords which are programmatically deduced.

It may happen that multiple audio file correlation data structures (such as that illustrated by table 300 of FIG. 3) may be available for use by a particular TTS system during the processing of Block 225 of FIG. 2. The preference information entered by the user at element 104 of FIG. 1 may, in some cases, be used to select from among these audio file correlation data structures. The number of correlations in a correlation data structure may range from a very small number to a very large number. In general, if more correlations are available, a finer granularity of contextual information can be conveyed to users who are listening to audio messages.

Returning now to FIG. 2, if the matching process of Block 225 has found the current tag in the audio correlations table (or similar data structure), then the location or other identifier of the sound file to be played for the upcoming message element is retrieved from the table. (If there is no match, then the result of Block 225 may be taken as locating a null sound file which will result in the absence of a background audio cue for this message segment; or, in other implementations it may be desirable to define a default background audio cue that will be used in such cases.) Block 230 tests whether the retrieved sound file is the same as the currently-applicable background file. If so, then in some preferred embodiments control merely returns to Block 200 while the audio cue continues.

In other preferred embodiments, it may be desirable not to continue the audio cue uninterrupted when the test in Block 230 has a positive result. For example, while the sample correlation file shown in FIG. 3 provides only one audio file correlation for paragraph tags (311, 321) and topic tags (312, 322), playing the associated audio file uninterrupted disguises the change from one paragraph to another, or from one topic to another. Depending on how the present invention is being used within a particular environment, it may be preferable to explicitly signal these types of changes to the listener using audio cues. In this case, the change may be signalled in a number of ways. In one simple approach, a temporary interruption in playing the audio cue may be provided by briefly stopping the sound following a positive result at Block 230. Or, the change may be signalled by varying the pitch or tone of the audio cue following this positive result, or perhaps by varying the pitch or tone of the speaking voice prior to operation of Block 210. In yet another approach, tags such as paragraph and topic tags, which will typically apply to every segment of a message, may be correlated with sound files using a cyclic definition mechanism. As an example, an array of sound file identifiers may be provided for use with paragraph tags, where an implementation of the present invention then programmatically selects a different one of the sound files from this array for each successive paragraph tag. In this manner, varying audio cues can be provided (without placing a burden on the message creator to place unique paragraph or topic tags within the message).

If the test in Block 230 has a negative result, indicating that the audio file is changing, then the currently-applicable audio cue is stopped (Block 235) and the new sound is played (Block 240), after which control returns to Block 200 to continue processing the message.

The logic of FIG. 2 assumes that the tags associated with a message are stored in-line, within the message itself Alternatively, this logic may be adapted for use with tags or keywords that are stored as metadata, if desired. In this case, the logic of Block 210 preferably comprises rendering an entire message segment that is associated with a particular metadata element, and control returns to Block 210 following a positive result in Block 230 and following Block 240 (to render the text associated with the audio file that was located at Block 225). When using metadata and in-line tags, the audio rendering of the elements of a message may be buffered if desired with the playback commencing once the audio cues are ready to mix in smoothly with the message.

Turning now to FIG. 4, logic is provided which may be used to process text files which do not have explicit tags associated with or embedded within them, and which also do not have explicitly-provided keywords stored as metadata. (Alternatively, the logic in FIG. 4 may be used with text files which have such features by adapting the logic of FIG. 4 and/or combining it with the logic of FIG. 2. Techniques for performing such modifications will be obvious to one of ordinary skill in the art once the teachings disclosed herein are known.) Instead, the logic of FIG. 4 is used to deduce keywords from the text of a message and to find sound files to be provided as audio cues for these deduced keywords.

The rendering of the enhanced message begins at Block 400, which checks to see whether the processing for this message is complete. If so, then the traversal of FIG. 4 ends. Otherwise, processing continues to Block 405 which checks to see if the next message segment is a new paragraph. (Paragraph changes may be detected by the presence of paragraph tags within some types of text documents, or perhaps by the presence of a "line return" character, as previously stated. An implementation of the logic of FIG. 4 may be adapted to detect these or other indicators.) If there is a new paragraph to be processed, then control reaches Block 415 which preferably scans the first sentence for a "key" noun (i.e. a noun that may be considered representative of the sentence). Techniques for semantically evaluating a text sentence in this manner are well known in the art and do not form part of the present invention. (Alternative implementations may scan more than the first sentence, if desired, in order to use a larger basis when determining the paragraph context, or may determine the context on a boundary other than per-paragraph.)

If the test in Block 405 has a negative result (i.e. this message segment is not a new paragraph), then at Block 410 the text of the segment is converted to speech (preferably using TTS techniques of the prior art) and played to the listener while the currently-active audio cue continues to play. Control then returns to Block 400 to continue processing this text file.

Control reaches Block 420 after Block 415 has scanned for a key noun in a new paragraph. The test in Block 420 checks to see if such a noun was located. If not, then it is not possible to deduce a context-specific sound to be played as an audio cue for this message segment using this approach, and control transfers to Block 410 where the text will be rendered with no change in the accompanying audio cue. (In alternative embodiments, a default audio cue may be provided for such situations, or the playing of a background audio may be suppressed, if desired.) When a key noun was located, on the other hand, control reaches Block 425 which matches the located noun with a corresponding sound. One or more tables of the type previously described with reference to FIG. 3 may be used for this purpose, for example by scanning the table for keywords such as 315 and 316. If there is a match, then the location or other identifier of the associated sound file is retrieved from the table. (As described with reference to Block 225 of FIG. 2, if there is no match, then the result of Block 425 may be taken as a null sound file which will result in the absence of a background audio cue for this message segment; or, a default background audio cue may be used in such cases.)

Block 430 then checks to see if the located sound file is the same as the currently-playing audio cue. If so, then in preferred embodiments control merely returns to Block 410 to begin playing the audio rendering of the text for this message segment while the audio cue continues. (In other embodiments, it may be desirable to signal to the listener that a new paragraph is being processed, even though the audio cue has not changed. In such cases, a pause or other indicator may be interjected into the background sound after a positive result in Block 430, in a similar manner to that described above with reference to Block 230 of FIG. 2.)

If the test in Block 430 has a negative result, indicating that the audio file is changing, then the currently-applicable audio cue is stopped (Block 435) and the new background sound is played (Block 440), after which control returns to Block 410 to begin playing the audio rendering of the text.

Techniques for blending or smoothing one sound file with another to minimize the abruptness of transitions between them are known in the art, and may be used when Blocks 435 and 440 (and also Blocks 235 and 240 of FIG. 2 and Blocks 630 and 635 of FIG. 6, discussed below) are executed, if desired. (As discussed earlier, it may be desirable in some cases to have an abrupt transition, in order to clearly signal the listener of a contextual change. In these cases, use of blending algorithms is preferably omitted.) Optionally, an audio cue might be used that fades away after playing for some particular period (for example, by playing at a stronger volume at the beginning of a each paragraph and then trailing off as the paragraph progresses).

Note that the technique illustrated in FIG. 4 is adapted to locating a key noun, and its associated audio cue, in real time while the audio rendering is being played to a listener. Similarly, FIG. 2 is adapted to locating tags and their associated audio cues while the audio rendering is being played to a listener. The located audio cue is thus preferably played for the entire duration of the message segment to which the key noun or tag applies (i.e. until a different key noun or tag is located). In some cases, the key noun or tag may apply to an entire text file, while in other cases a key noun may apply only to a one-sentence paragraph (according to the approach in FIG. 4) or a tag may apply to a single word or even a few characters within a word (e.g. when letters within a word have been highlighted in color). The disclosed techniques may alternatively be used to mix audio cues with audio streams in batch (i.e. non-real-time) mode, by applying the logic of FIG. 2 and/or FIG. 4 to stored files to generate a mixed stream (or perhaps a marked stream, where the mixing has not actually occurred but markers have been provided to indicate which streams are to be mixed at which points during playback). The rendering of these already mixed or marked streams then occurs at some subsequent time.

Figure 5A:
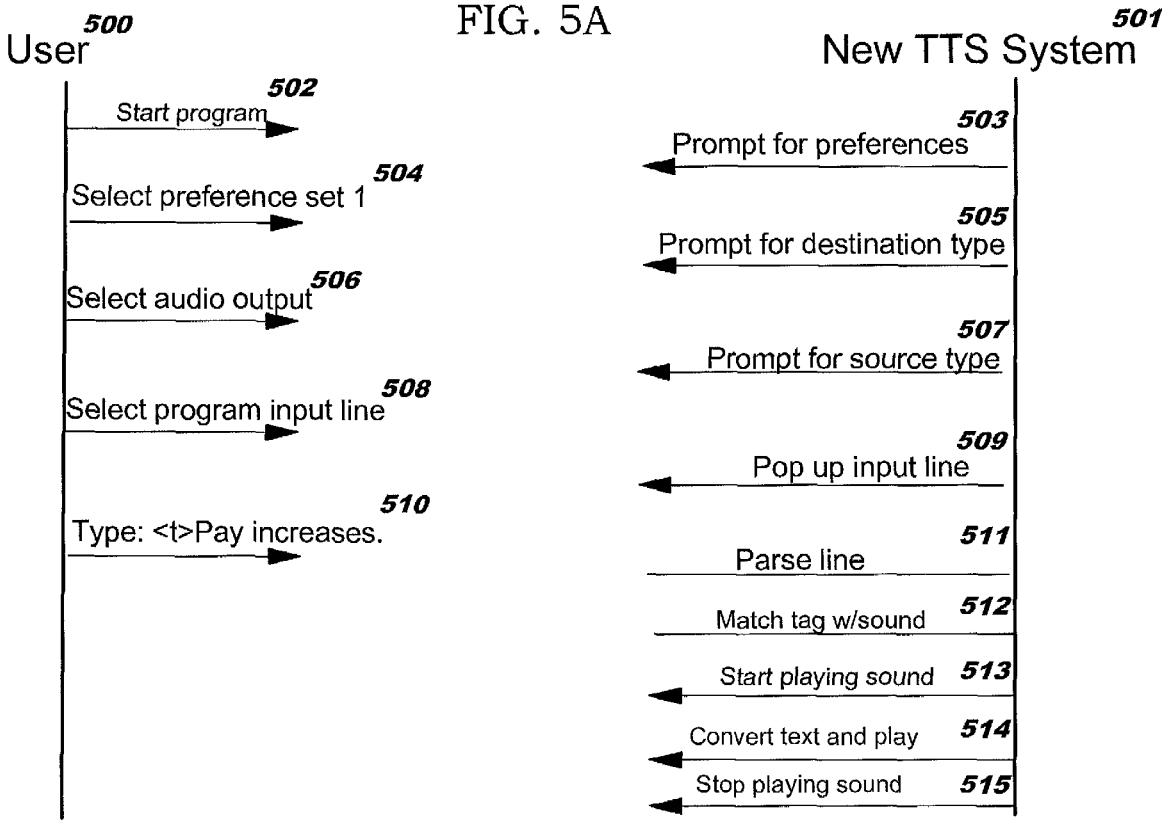
FIGS. 5A and 5B provide a flow diagram illustrating an alternative example of how a message recipient may invoke a system which provides features of the present invention.
Figure 5B:
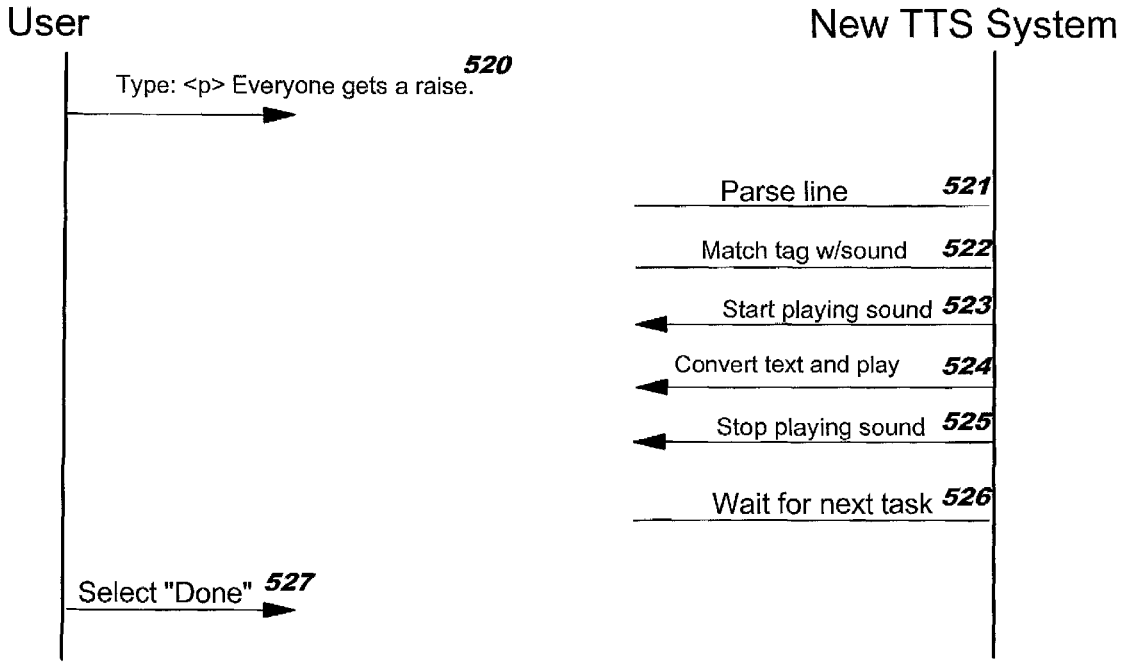

FIGS. 5A and 5B provide a flow diagram showing an alternative example of how a user 500 may invoke a TTS system 501 that provides features of the present invention. Flows 502 through 507 are analogous to flows 102 through 107 of FIG. 1. At 508, the user indicates that she would like the audio rendering to operate on text provided through a program input line (for example to translate text provided with keyboard input). In response, the TTS system displays an input line (509) or other similar entry field. The user types her message, shown in the example at 510 as comprising an opening topic tag ("<t>") and a 2-word textual message. The TTS system then parses this input (511), preferably using text parsing logic of the type described above for FIG. 2. Having detected the presence of the opening topic tag, the TTS system then searches (512) for an audio cue that has been correlated with this tag according to the present invention. Assuming for purposes of the example that a matching sound file is located, the TTS system begins playing that sound (513) to the listener (who is also the message creator, in this example). The TTS system then converts the text of the user's message, "Pay increases.", and plays the audio rendering to the listener (514). Optionally, the TTS system may also search the text string for in-line keywords (not shown in FIG. 5), using the techniques described above with reference to FIG. 4; in this case, an audio cue different from that located at 512 may be provided while some or all of the message playback is occurring at 514. When the message playback is finished, the TTS system preferably stops playing the audio cue, as shown at 515, and awaits the user's next command or input.

As shown at 520 of FIG. 5B, the user may continue providing textual input from the program input line by typing another sentence, which in this example also has a leading tag. In an analogous manner to flows 511–515, the TTS system processes this new textual input as shown at flows 521–525, providing an audio cue for the paragraph tag "<p>" (see 522) and playing the audio rendering of this new text (see 524). Upon finishing the audio rendering, the audio cue is preferably stopped (525), after which the TTS system preferably then waits for the user's next command (526). In this example, the user indicates that she is done using this function (527).

Note that while the example in FIGS. 5A and 5B shows the TTS system waiting until the user completes a line of input (e.g. by pressing a return key) until starting the text parsing and tag matching process, the TTS system could alternatively begin parsing and matching tags as soon as the user begins entering text.

Figure 6:
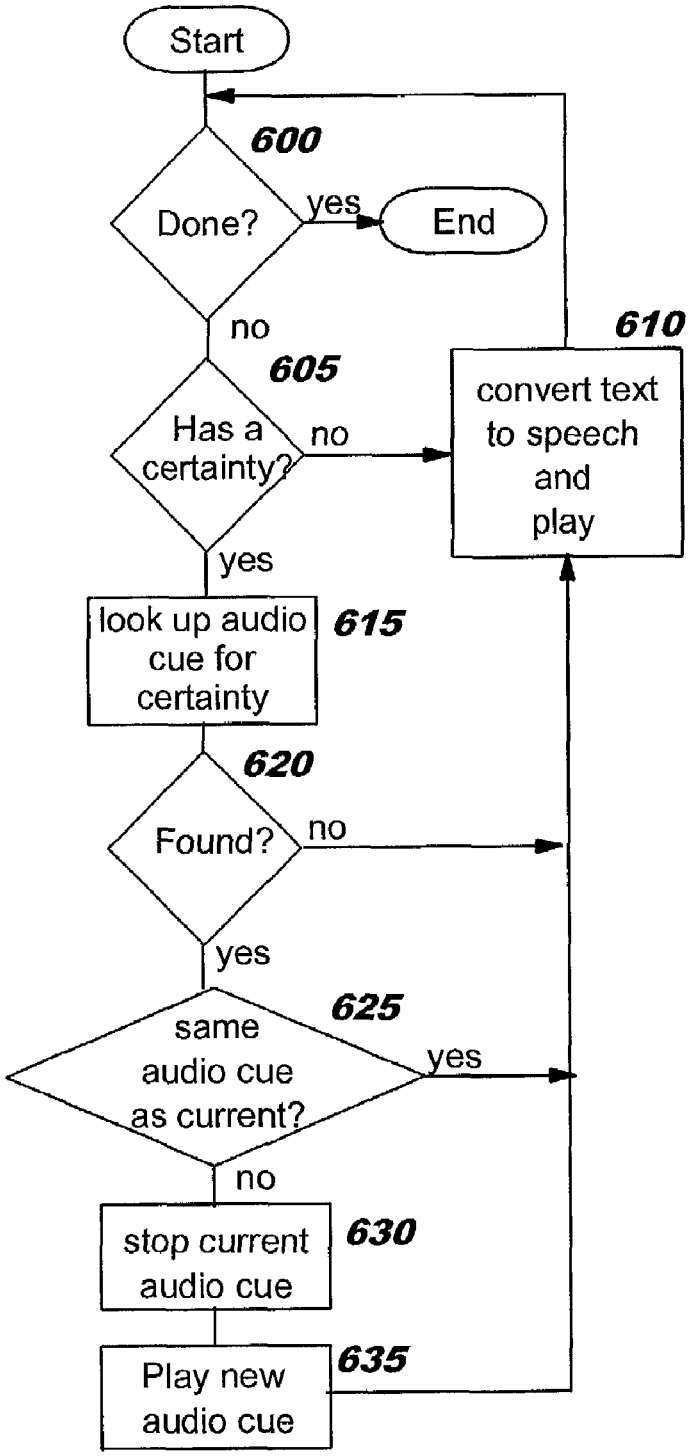

Referring now to FIG. 6, logic is provided which may be used to process text files which have been transformed at least once, for example by an audio-to-text translation that occurs when using a voice recognition system or by a text-to-text translation that occurs when translating text from one language to another, where the playback to the listener is being enhanced with audio cues as to the degree of certainty of the translation. The logic shown in FIG. 6 assumes that the translation has already occurred, and that a stored text file exists which has been marked in some way with certainty indicators which reflect the degree of certainty in the translation. In some implementations, a single translation certainty may be associated with the entire text file. In other implementations, a translation certainty may be associated with individual words or groups of words. The manner in which these types of translations are performed, and in which the corresponding translation certainty value is determined, does not form part of the present invention. Instead, it is assumed that prior art translation systems are used for translation and as stated earlier, that such systems adapted such that they are aware of when a particular word or phrase is subject to multiple interpretations and/or multiple translations, and are also adapted to provide a certainty indicator in these cases.

In some cases, a file may have been translated more than once. For example, an audio file may be converted to a text file by a voice recognition system, and that text file may then be converted to a different language using a text-to-text translator. In this case, the degrees of certainty of the multiple translations are preferably factored together such that a single certainty indicator is stored with the final resulting file or with individual segments thereof (As stated earlier, translation certainty may also be indicated to a message listener using audio cues that reflect the degree of certainty in translating text to speech using a TTS system. The logic used to implement this aspect of the present invention will be described with reference to Block 610 of FIG. 6.)

The rendering of an enhanced message which uses audio cues for translation certainty begins at Block 600, which checks to see whether the processing for this message is complete. If so, then the traversal of FIG. 6 ends. Otherwise, processing continues to Block 605 which checks to see if the next message segment has a translation certainty indicator associated with it. The logic of FIG. 6 assumes that the indicators are stored as metadata, rather than being embedded within the translated file. (It will be obvious to one of ordinary skill in the art how this logic may be modified to support embedded certainty indicators.) If there is a certainty indicator to be processed, then control reaches Block 615 which preferably uses the stored certainty indicator to access a data structure, such as the example shown in FIG. 7 using a table format, to find the audio cue associated with the certainty indicator.

Referring now to FIG. 7, a table 700 is shown in which a correlation between translation certainty and audio cues is stored. Note that this is merely one example of the way in which this correlation may be provided; other techniques, including use of arrays or linked list data structures, will be obvious to one of skill in the art. In this example, translation certainty values 700 are stored along with a corresponding sound file 720 for each value. Indicators 711–715 have been specified using text in this example, but may alternatively be stated simply as numeric values (including a numeric percentage value, or simply a value such as 1 through 10), or perhaps as relative values such as "low", "medium", and "high" or simply some character string (such as "a1") that is provided by the translation program for which a correspondence table contains stored entries. The sound files 721–735 in this example are identified using directory structure and files names of files such as "\tts\low.abc" 721 and "\tts\high.abc" 735 which presumably identify audio files of some type that would convey a low degree of certainty and a high degree of certainty to a listener. (As will be obvious, a listener may have to be told how to interpret these audio cues.)

Figure 9:
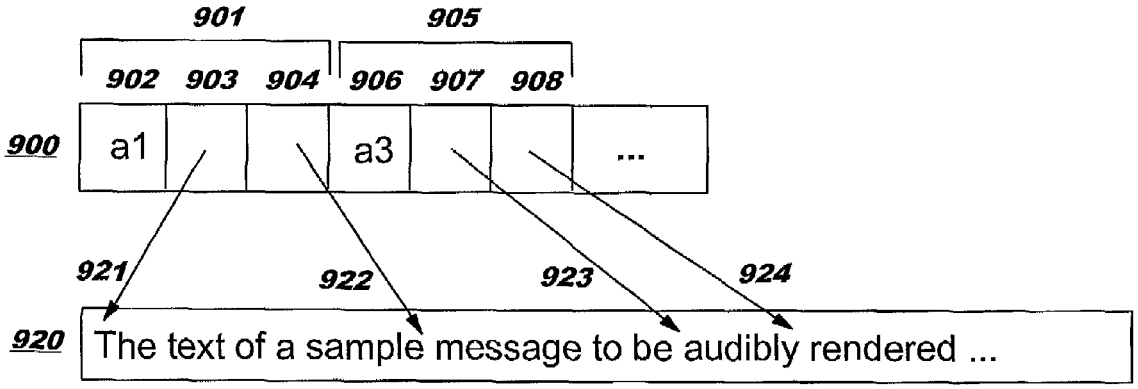

An example data structure that may be used for storing translation certainty indicators is shown in FIG. 9. When translation certainty indicators are provided for segments of a file (such as for words or groups of words), then a list or array of certainty indicators such as that shown at 900 may be used. If a single certainty indicator applies to an entire file, then this list or array structure preferably has a single entry; or, alternatively, the single certainty indicator may be prepended to the stored file (in which case the logic of FIG. 6 is adapted to expect an indicator in that position).

An individual element 901 of the structure 900 preferably contains a certainty value field 902, a starting pointer 903 that points within the text file to the segment to which this certainty applies, and an optional ending pointer 904 that points to the end of the text to which this certainty applies. Or, rather than using an ending pointer 904, it may be assumed that a particular certainty applies until a new certainty applies (in which case a new element 905 will contain an indicator 906 and pointer 907 to be used for the next successive text). As shown in the example, a hypothetical text file 920 has a certainty indicator "a1" in field 902, and the starting pointer in field 903 points to the beginning 921 of the text in text file 920. This certainty indicator applies to the text up through some point 922, as shown by the ending pointer 904. The next certainty indicator "a3" in field 906 points 907 to a location 923 in text file 920, continuing up through location 924 (as shown by ending pointer 908). An implementation of the present invention may presume that a default certainty applies to the gap between 922 and 923, if desired, or may alternatively omit use of an audio cue during this gap.

Returning to FIG. 6, if the test in Block 605 has a negative result (i.e. this message segment does not have a certainty indicator), then at Block 610 the text of the segment is converted to speech (preferably using TTS techniques of the prior art) and played to the listener. In the preferred embodiment shown in FIG. 6, the currently-applicable audio cue continues to play. (As just discussed, a default certainty may optionally be used to determine a new audio cue in this case. Or, the audio cue may be suppressed until a message segment having a certainty indicator is located.) Control then returns to Block 600 to continue processing this text file.

Note that this processing in Block 610 assumes that the certainty reflects a prior translation, rather than the translation between text and speech that is performed during Block 610. A certainty indicator of the text-to-speech translation itself may be provided in addition to, or instead of, a certainty pertaining to an earlier translation. In either of these cases, the TTS translation system preferably provides a certainty value as an output along with each translated word or phrase. The audio word or phrase is preferably buffered in Block 610 until the certainty value is available, and this certainty value is used to obtain the associated audio cue (using logic analogous to that in Blocks 615 through 635). Once the associated audio cue is available, it may be mixed in with the buffered audio word or phrase and played to the listener. When the certainty value obtained from the TTS system is used in addition to a previously-determined certainty, then the two values are preferably algorithmically combined to determine the certainty indicator to be used when accessing the stored audio cue correlation information. (For example, the values may be combined by averaging if expressed as percentages, or perhaps by accessing a data structure provided for this purpose that indicates, as an example, how to combine a value of "x1" with a value of "y2".) When the certainty value obtained from the TTS system is to be used instead of a previously-determined certainty, then this single certainty indicator is used to access the correlation information.

In the case where the translation certainty is audibly reflected to the listener by varying the tone or pitch of the speaker's voice during the audio rendering, rather than by providing a separate audio cue using a mixed-in background audio stream, then Block 610 preferably comprises adjusting relevant parameters of the TTS system accordingly prior to rendering the word or phrase to which the certainty indicator applies (and, preferably, no separate background audio cue is played at Block 635).

Returning again to the discussion of traversing the logic of FIG. 6, control reaches Block 615 when Block 605 located a certainty indicator for the text of the segment being processed. Block 615 then accesses the stored certainty-to-audio cue correlation information (such as the table in FIG. 7) using the certainty indicator. The test in Block 620 checks to see if an audio cue file name or other identifier was located. If not, then control transfers to Block 610 where the text will be rendered with no change in the accompanying audio cue. (In alternative embodiments, a default audio cue may be provided for such situations, if desired, or use of a background audio cue may be suppressed for this message segment.) When an audio cue for this certainty indicator was located, on the other hand, control reaches Block 625 which checks to see if the located sound file is the same as the currently-playing audio cue. If so, then in preferred embodiments control merely returns to Block 610 to begin playing the audio rendering of the text for this message segment while the audio cue continues. (In other embodiments, it may be desirable to signal to the listener that a new certainty value is being processed, even though the audio cue has not changed. In such cases, a pause or other indicator may be interjected into the background sound after a positive result in Block 625, in a similar manner to that described above with reference to Block 230 of FIG. 2.)

If the test in Block 625 has a negative result, indicating that the audio file is changing, then the currently-applicable audio cue is stopped (Block 630) and the new sound is played (Block 635), after which control returns to Block 610 to begin playing the audio rendering of the text.

When the present invention is being used to reflect the degree of certainty in the identification of a speaker of a source audio message, then the voice recognition system performing this identification preferably provides a certainty value using a data structure such as that shown in FIG. 9. The information in the data structure may therefore be processed in an analogous manner to that shown in FIG. 6.

Figure 8:
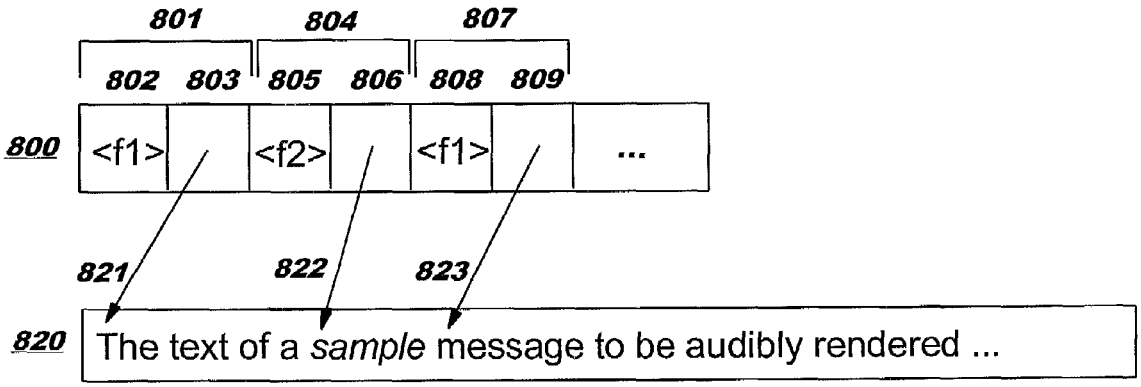
FIGS. 8 and 9 depict examples of data structures that may be used to facilitate implementation of preferred embodiments of the present invention.

FIG. 8 depicts a data structure that may be used to associate tags and/or keywords with message segments as metadata. In this example, an individual element 801 of the structure 800 contains (1) a tag 802, and (2) a pointer 803 that points within the text file to the segment to which this tag applies. As shown in the example, a hypothetical text file 820 has a first tag value "<f1>" 802 which may represent, for instance, the font of the associated text segment which begins at location 821; a second tag value "<f2>" 805 which indicates a change in the text file (in this case, a change to an italic font) for the text beginning at location 822, which is pointed to by pointer 806 of element 804; a third tag value "<f1>" 808 indicating a return to the original tag for the text beginning at location 823, which is pointed to by pointer 809 of element 807; and so forth. Alternatively, keyword values may be stored in the elements, along with a pointer to the text segment for which this keyword applies. Or, tags and keywords may be mixed within a data structure such as 800, if desired.

It may happen in some cases that more than one tag applies to a message segment or word. In that case, the data structures of FIGS. 8 and 9 may optionally be altered to provide multiple metadata values for a single pointer, and/or the processing logic of FIGS. 2 and 4 may be modified to detect more than one successive in-line tag. In addition, the correlation data structure (such as the table in FIG. 3) may be modified to support use of multiple index values when locating the corresponding audio cue. Alternatively, an implementation may choose to process the multiple tags or keywords in order using the previously-described techniques, in which case all but the final tag or keyword will likely be subsumed and not actually heard by the listener.

As has been demonstrated, the present invention provides advantageous techniques to alleviate disadvantages of distance communication, for example by conveying context such as emotions in audio messages or by audibly signalling a change of topic, translation certainty, and so forth.

U.S. Pat. No. 6,108,629, which is entitled "Method and Apparatus for Voice Interaction Over a Network Using an Information Flow Controller", describes a technique for reading the content of documents to a user, where the document may have a number of markup tags embedded therein. In some modes, a type of audio cue is provided to the user. For example, a "bing" sound is announced as a hypertext link is passed over while skimming through text in fast forward mode, with the bing sounds giving the user a sense of how many such links are being passed over. (See column 6, lines 47–53.) Also, a type of contextual information is announced in some modes, such as announcing "one minute" and then "two minutes" and so forth, prior to playing a music snippet as the audio browser accelerates through music, where the time announcements thereby signify to the listener where they are in the document. (See column 6, lines 23–30.) However, the disclosed techniques are distinct from the teachings of the present invention because they do not address, inter alia, (1) mixing in background sounds during an audio rendering of non-audio information (e.g. to convey contextual information or certainty of translation) nor (2) use of stylesheets to affect audio renderings of non-audio information. There is no discussion therein of the use of background audio cues to enhance an audio rendering to reflect (for example) changes in the font or color of text from an underlying source document, nor to reflect the importance of the text or the topic of the text. Rather than mixing audio cues as background sounds during an audio rendering, to the best of the present inventors' knowledge and belief, the disclosed techniques of this prior art patent use audio information that is inserted in-line in the audio rendering.

As will be appreciated by one of skill in the art, embodiments of the present invention may be provided as methods, systems, or computer program products. Accordingly, the present invention may take the form of an entirely hardware embodiment, an entirely software embodiment or an embodiment combining software and hardware aspects. Furthermore, the present invention may take the form of a computer program product which is embodied on one or more computer-usable storage media (including, but not limited to, disk storage, CD-ROM, optical storage, and so forth) having computer-usable program code embodied therein.

The present invention has been described with reference to flowchart illustrations and/or flow diagrams of methods, apparatus (systems) and computer program products according to embodiments of the invention. It will be understood that each block of the flowchart illustrations and/or flow diagrams, and combinations of blocks in the flowchart illustrations and/or flows in the flow diagrams, can be implemented by computer program instructions. These computer program instructions may be provided to a processor of a general purpose computer, special purpose computer, embedded processor or other programmable data processing apparatus to produce a machine, such that the instructions, which execute via the processor of the computer or other programmable data processing apparatus, create means for implementing the functions specified in the flowchart and/or flow diagram block(s) or flow(s).

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart and/or flow diagram block(s) or flow(s).

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart and/or flow diagram block(s) or flow(s). Furthermore, the instructions may be executed by more than one computer or data processing apparatus.

While the preferred embodiments of the present invention have been described, additional variations and modifications in those embodiments may occur to those skilled in the art once they learn of the basic inventive concepts. Therefore, it is intended that the appended claims shall be construed to include both the preferred embodiments and all such variations and modifications as fall within the spirit and scope of the invention.

We claim:

1. A method of enhancing audio renderings of non-audio data sources, comprising:

detecting a nuance of a non-audio data source;

locating an audio cue corresponding to the detected nuance; and associating the located audio cue with the detected nuance for playback to a listener, wherein detecting a nuance of a non-audio data source detects a plurality of nuances of the non-audio data source, locating an audio cue locates audio cues for each of the detected nuances, and associating the located audio cue with the detected nuance for playback to a listener associates each of the located audio cues with the respective detected nuance, and further comprising:

creating an audio rendering of the non-audio data source; and mixing the associated audio cues in with the audio rendering to generate integrated sounds therefrom to the listener.

2. The method according to claim 1, wherein mixing the associated audio cues occurs while playing the audio rendering to the listener.

3. The method according to claim 1, wherein the non-audio data source is a text file and wherein creating an audio rendering of the non-audio data source further comprises processing the text file with a text-to-speech translator.

4. The method according to claim 1, wherein at least one of the detected nuances is presence of a formatting tag.

5. The method according to claim 4, wherein the formatting tag is a new paragraph tag.

6. The method according to claim 1, wherein the non-audio data source is a text file and at least one of the detected nuances is a change in color of text in the text file.

7. The method according to claim 1, wherein the non-audio data source is a text file and the detected nuance is a change in font of text in the text file.

8. The method according to claim 1, wherein the non-audio data source is a text file and the detected nuance is presence of a keyword for the text file.

9. The method according to claim 8, wherein the keyword is supplied by a creator of the text file.

10. The method according to claim 8, wherein the keyword is programmatically detected by evaluating text in the text file.

11. The method according to claim 1, wherein the non-audio data source is a text file and at least one of the detected nuances is presence of an emoticon in the text file.

12. The method according to claim 1, wherein the detected nuance is a change of topic in the non-audio data source.

13. The method according to claim 1, wherein at least one of the detected nuances is a degree of certainty in translation of the non-audio data source from another format.

14. The method according to claim 13, wherein detecting a nuance of a non-audio data source detects at least two different degrees of certainty, and wherein the located audio cues comprise changes in a pitch of a voice used in the audio rendering for each of the different degrees of certainty.

15. The method according to claim 13, wherein detecting a nuance of a non-audio data source detects at least two different degrees of certainty, and further comprising changing a pitch of the associated audio cue used by mixing the associated audio cues in with the audio rendering for each of the different degrees of certainty.

16. The method according to claim 13, wherein detecting a nuance of a non-audio data source detects at least two different degrees of certainty, and wherein mixing the associated audio cues in with the audio rendering further comprises alternating between two of the located audio cues to audibly indicate the different degrees of certainty.

17. The method according to claim 13, wherein the other format is an input audio data source and the non-audio data source is a text file, and the translation is an audio-to-text translation from the input audio data source to the text file, and wherein the degree of certainty reflects accuracy of the audio-to-text translation.

18. The method according to claim 13, wherein the other format is an input audio data source and the non-audio data source is a text file, and the translation is an audio-to-text translation from the input audio data source to the text file, and wherein the degree of certainty reflects identification of a speaker who created the input audio data source.

19. The method according to claim 13, wherein the other format is a source text file and the non-audio data source is an output text file, and the translation is a text-to-text translation from the source text file to the output text file, and wherein the degree of certainty reflects accuracy of the text-to-text translation.

20. The method according to claim 19, wherein the source text file contains text in a first language and the output text file contains text in a second language.

21. A system for enhancing audio renderings of non-audio data sources, comprising:

means for detecting one or more nuances of a non-audio data source;

means for locating an audio cue corresponding to each of the detected nuances;

means for associating the located audio cues with their respective detected nuances for playback to a listener;

means for creating an audio rendering of the non-audio data source, wherein the non-audio segment is associated with the nuance; and means for mixing the associated audio cues in with the audio rendering to generate integrated sounds therefrom to the listener.

22. The system according to claim 21, wherein the non-audio data source is a text file and wherein the means for creating further comprises means for processing the text file with a text-to-speech translator.

23. The system according to claim 21, wherein at least one of the detected nuances is presence of a formatting tag.

24. The system according to claim 46, wherein the formatting tag is a new paragraph tag.

25. The system according to claim 21, wherein the non-audio data source is a text file and the detected nuance is a change in font of text in the text file.

26. The system according to claim 21, wherein the non-audio data source is a text file and at least one of the detected nuances is presence of an emoticon in the text file.

27. The system according to claim 21, wherein the detected nuance is a change of topic in the non-audio data source.

28. The system according to claim 21, wherein at least one of the detected nuances is a degree of certainty in translation of the non-audio data source from another format.

29. The system according to claim 28, wherein the means for detecting detects at least two different degrees of certainty, and wherein the located audio cues comprise changes in a pitch of a voice used in the audio rendering for each of the different degrees of certainty.

30. The system according to claim 28, wherein the means for detecting detects at least two different degrees of certainty, and further comprising means for changing a pitch of the associated audio cue used by the means for mixing for each of the different degrees of certainty.

31. The system according to claim 28, wherein the other format is an input audio data source and the non-audio data source is a text file, and the translation is an audio-to-text translation from the input audio data source to the text file, and wherein the degree of certainty reflects accuracy of the audio-to-text translation.

32. The system according to claim 28, wherein the other format is an input audio data source and the non-audio data source is a text file, and the translation is an audio-to-text translation from the input audio data source to the text file, and wherein the degree of certainty reflects identification of a speaker who created the input audio data source.

33. The system according to claim 28, wherein the other format is a source text file and the non-audio data source is an output text file, and the translation is a text-to-text translation from the source text file to the output text file, and wherein the degree of certainty reflects accuracy of the text-to-text translation.

34. The system according to claim 21, wherein the non-audio data source is an e-mail message and at least one of the detected nuances is an e-mail convention found in the e-mail message.

35. The system according to claim 21, wherein the non-audio data source is text provided by a user.

36. The system according to claim 21, wherein the detected nuance is embedded within the non-audio file.

37. The system according to claim 21, wherein the detected nuance comprises metadata associated with the non-audio file.

38. A computer program product for enhancing audio renderings of non-audio data sources, the computer program product embodied on one or more computer-readable media and comprising:

computer-readable program code that is configured to detect one or more nuances of a non-audio data source;

computer-readable program code that is configured to locate an audio cue corresponding to each of the detected nuances;

computer-readable program code that is configured to associate the located audio cues with their respective detected nuances for playback to a listener;

computer-readable program code that is configured to create an audio rendering of a non-audio segment of the non-audio data source, wherein the non-audio segment is associated with the nuance; and computer-readable program code that is configured to mix the associated audio cue with the audio rendering of the segment to generate integrated sounds therefrom to the listener.

39. The computer program product according to claim 38, wherein the non-audio data source is a text file and wherein the computer-readable program code that is configured to create further comprises computer-readable program code that is configured to process the text file with a text-to-speech translator.

40. The computer program product according to claim 38, wherein the non-audio data source is a text file and at least one of the detected nuances is a change in color of text in the text file.

41. The computer program product according to claim 38, wherein the non-audio data source is a text file and the detected nuance is presence of a keyword for the text file.

42. The computer program product according to claim 41, wherein the keyword is supplied by a creator of the text file.

43. The computer program product according to claim 41, wherein the keyword is programmatically detected by evaluating text in the text file.

44. The computer program product according to claim 38, wherein at least one of the detected nuances is a degree of certainty in translation of the non-audio data source from another format.

45. The computer program product according to claim 44, wherein the computer-readable program code that is configured to detect detects at least two different degrees of certainty, and wherein the located audio cues comprise changes in a pitch of a voice used in the audio rendering for each of the different degrees of certainty.

46. The computer program product according to claim 44, wherein the computer-readable program code that is configured to detect detects at least two different degrees of certainty, and further comprising changing a pitch of the associated audio cue used by the computer-readable program code that is configured to mix for each of the different degrees of certainty.

47. The computer program product according to claim 44, wherein the other format is an input audio data source and the non-audio data source is a text file, and the translation is an audio-to-text translation from the input audio data source to the text file, and wherein the degree of certainty reflects accuracy of the audio-to-text translation.

48. The computer program product according to claim 44, wherein the other format is an input audio data source and the non-audio data source is a text file, and the translation is an audio-to-text translation from the input audio data source to the text file, and wherein the degree of certainty reflects identification of a speaker who created the input audio data source.

49. The computer program product according to claim 44, wherein the other format is a source text file and the non-audio data source is an output text file, and the translation is a text-to-text translation from the source text file to the output text file, and wherein the degree of certainty reflects accuracy of the text-to-text translation.

50. The computer program product according to claim 49, wherein the source text file contains text in a first language and the output text file contains text in a second language.

51. The computer program product according to claim 38, wherein at least one of the detected nuances is an identification of a creator of the non-audio data source.

52. The computer program product according to claim 51, wherein the identification is used to locate stored preferences of the creator.

53. The computer program product according to claim 38, wherein the non-audio data source is an e-mail message.

54. The computer program product according to claim 38, wherein the detected nuance is embedded within the non-audio file.

55. The computer program product according to claim 38, wherein the detected nuance comprises metadata associated with the non-audio file.

* * * * *